US006343203B1

(12) United States Patent
Pang

(10) Patent No.: US 6,343,203 B1
(45) Date of Patent: Jan. 29, 2002

(54) IMAGE BANDING REDUCTION METHOD OF PHOTORECEPTOR MEDIUM OF INDIRECT TRANSFER TYPE IMAGE FORMING APPARATUS

(75) Inventor: Jeong-hun Pang, Suwon (KR)

(73) Assignee: Samsung Electronics Co., LTD, Kyungki-do (KR)

( * ) Notice: Subject to any disclaimer, the term of this patent is extended or adjusted under 35 U.S.C. 154(b) by 0 days.

(21) Appl. No.: 09/654,170

(22) Filed: Sep. 1, 2000

(30) Foreign Application Priority Data

Sep. 1, 1999 (KR) ..... 99-36849

(51) Int. Cl.[7] ..... G03G 15/16
(52) U.S. Cl. ..... 399/307; 399/388; 399/397
(58) Field of Search ..... 399/66, 307, 388, 399/397

(56) References Cited

U.S. PATENT DOCUMENTS 5,956,553 A * 9/1999 Park ..... 399/307

* cited by examiner

*Primary Examiner*—William J. Royer
(74) *Attorney, Agent, or Firm*—Sughrue Mion, PLLC

(57) ABSTRACT

To prevent banding occurring by a change in the speed of the photoreceptor medium generated when the leading edge and trailing edge of a sheet of paper pass through a transfer nip formed between a transfer roller and a fusing roller, an image banding reduction method of a photoreceptor medium of an indirect transfer type image forming apparatus is achieved by (A) separating the transfer roller and the fusing roller a predetermined distance from each other before the leading edge of paper enters the transfer nip, (B) approximating the transfer roller and the fusing roller after the leading edge of paper has entered the transfer nip, and maintaining the gap of the transfer nip in a normal state, and (C) separating again the transfer roller and the fusing roller a predetermined distance from each other before the trailing edge of paper is exhausted from the transfer nip.

10 Claims, 8 Drawing Sheets

IMAGE BANDING REDUCTION METHOD OF PHOTORECEPTOR MEDIUM OF INDIRECT TRANSFER TYPE IMAGE FORMING APPARATUS

BACKGROUND OF THE INVENTION

1. Field of the Invention

The present invention relates to an image banding reduction method of a photoreceptor medium of an indirect transfer type image forming apparatus having an improved structure in which a change in the speed of a photoreceptor web can be maintained to a minimum when an image formed on the photoreceptor web is indirectly transferred to a sheet of paper transferring between the fusing roller and the transfer roller.

2. Description of the Related Art

In general, an indirect transfer type image forming apparatus such as a color laser printer or a photocopier is for printing a desired image by developing an electrostatic latent image formed on a photoreceptor medium such as a photoreceptor web or a photoreceptor drum with a developer having a predetermined color and transferring the developed image to a sheet of paper.

Referring to FIG. 1, in the indirect transfer type image forming apparatus, an electrostatic latent image is formed on a surface of a photoreceptor web 10 circulating along an endless path, by an electrostatic latent image forming device such as a laser scanning unit (LSU) 32. A toner image is formed on the surface of the photoreceptor web 10 by developing the electrostatic latent image with a development unit 20. The image forming apparatus includes a transfer unit 30 having a transfer roller 22 and a fusing roller 24 to transfer the toner image formed on the photoreceptor web 10 to a sheet of paper P. However, when a leading edge $E_l$ of the paper enters a transfer nip $N_t$ between the transfer roller 22 and the fusing roller 24, a pressing force applied to the transfer nip $N_t$ changes due to the thickness of the paper. As a result, the proceeding speed of the photoreceptor web 10 changes.

FIG. 2 is a graph showing changes in the speed of the photoreceptor web 10 at the moment when the leading edge $E_l$ of paper enters the transfer nip $N_t$ or a trailing edge $E_t$ thereof is exhausted from the transfer nip $N_t$ in a conventional indirect transfer type image forming apparatus, and a banding phenomenon of an image according to the above change, obtained through experiments. In the graph, the vertical axis indicates changes ($\Delta v$) in the speed of the photoreceptor web with respect to a regular speed (v) thereof which is calculated in percent. A positive value means acceleration and a negative value means deceleration in the speed of photoreceptor web 10. The horizontal axis indicates time. Here, a portion A is a moment when the leading edge $E_l$ enters the transfer nip $N_t$ and a portion B is a moment when a trailing edge $E_t$ of the paper is exhausted from the transfer nip $N_t$. That is, the speed of the photoreceptor web 10 changes due to impact generated when the paper P enters and is exhausted from the transfer nip $N_t$. The factor possibly ill-affecting the constancy of the photoreceptor web driven by a driving roller is the thickness of the paper itself periodically entering between the transfer roller and the fusing roller, and this actually causes a considerable speed change of the photoreceptor web. The lower portion of the drawing shows an example of an image printed on a sheet of paper effected by changes in the speed of the photoreceptor web. Here, the image at a portion where the speed of the photoreceptor web increases excessively appears light while the image at the portion where the speed of the photoreceptor web decreases excessively appears dark, which is preferred to as image banding.

Here, the moment when the leading edge of the paper 26 enters between the transfer roller 22 and the fusing roller 24 is $\Delta t_1$, the time for maintaining a constant speed after the paper enters is $\Delta t_2$, and the moment when the trailing edge of the paper is exhausted between the transfer roller 22 and the fusing roller 24 is $\Delta t_3$. The type of banding generated to the image, that is, the change in width $\Delta L$ of banding or concentration of the image is closely related to the change in speed of the photoreceptor web 10.

The change of the concentration of the image depends on the amount of the speed change of the photoreceptor web and the width of banding $\Delta L$ depends on the duration of the change of the speed $\Delta t$. The width of the banding $\Delta L$ can be expressed as shown in Equation 1.

$$\Delta L = \upsilon \times \Delta t \qquad \text{[Equation 1]}$$

Here $\upsilon$ is the speed of the photoreceptor web.

As the paper passing between the fusing roller and the transfer roller is always pressed by a constant pressing force, at the moment A when the leading edge of the paper is caught between the transfer nip or at the moment B when the trailing edge of the paper is exhausted from the transfer nip, the rotation speed of the transfer roller instantly increases or decreases so that the circulating speed of the photoreceptor web changes considerably. Then, when the electrostatic latent image is formed on the photoreceptor web by the laser scanning unit, a change in the scanning position is generated according to the change of speed of the photoreceptor web as shown in portions A and B of FIG. 2 so that the quality of print is lowered.

SUMMARY OF THE INVENTION

To solve the above problems, it is an objective of the present invention to provide a method of reducing banding in an image due to changes in the speed of a photoreceptor medium of an indirect transfer type image forming apparatus, by which the change of speed of the photoreceptor web is minimized during the formation of an electrostatic latent image on the photoreceptor medium using an LSU, when the paper arrives at or is exhausted from the transfer nip, so that a superior print quality can be guaranteed.

Accordingly, to achieve the above objective, there is provided an image banding reduction method of a photoreceptor medium of an indirect transfer type image forming apparatus for preventing banding occurring by a change in the speed of the photoreceptor medium generated when the leading edge and trailing edge of a sheet of paper pass through a transfer nip formed between a transfer roller and a fusing roller, which is achieved by (A) separating the transfer roller and the fusing roller a predetermined distance from each other before the leading edge of paper enters the transfer nip, (B) approximating the transfer roller and the fusing roller after the leading edge of paper has entered the transfer nip, and maintaining the transfer nip in a normal state, and (C) separating again the transfer roller and the fusing roller a predetermined distance from each other before the trailing edge of paper is exhausted from the transfer nip.

Also, to achieve the above objective, there is provided an image banding reduction method of a photoreceptor medium of an indirect transfer type image forming apparatus for preventing banding occurring by a change in the speed of the photoreceptor medium generated when the leading edge and trailing edge of a sheet of paper pass through a transfer nip formed between a transfer roller and a fusing roller, which is achieved by (A) reducing a pressing force applied between the transfer roller and the fusing roller to be less than the pressing force in a normal state, before the leading edge of paper enters the transfer nip, (B) restoring the pressing force applied between the transfer roller and the fusing roller to the normal state after the leading edge of paper has entered the transfer nip, and (C) reducing the pressing force applied between the transfer roller and the fusing roller less than the pressing force in the normal state, before the trailing edge of paper is exhausted from the transfer nip.

BRIEF DESCRIPTION OF THE DRAWINGS

The above objective and advantages of the present invention will become more apparent by describing in detail a preferred embodiment thereof with reference to the attached-drawings in which.

DETAILED DESCRIPTION OF THE INVENTION

Figure 1:
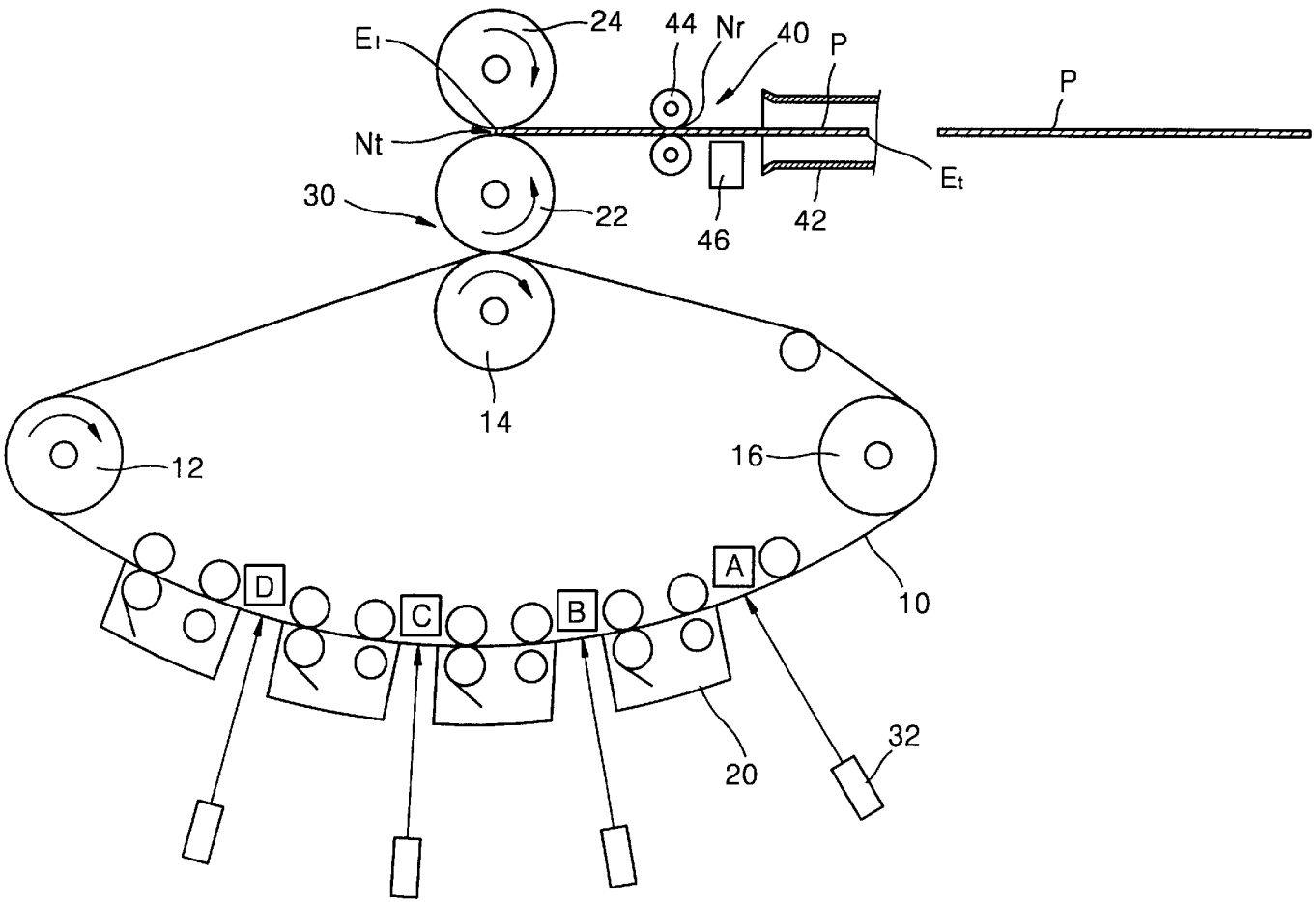
FIG. 1 (PRIOR ART)
FIG. 1 is a view showing the structure of a general indirect transfer type image forming apparatus.
Figure 2:
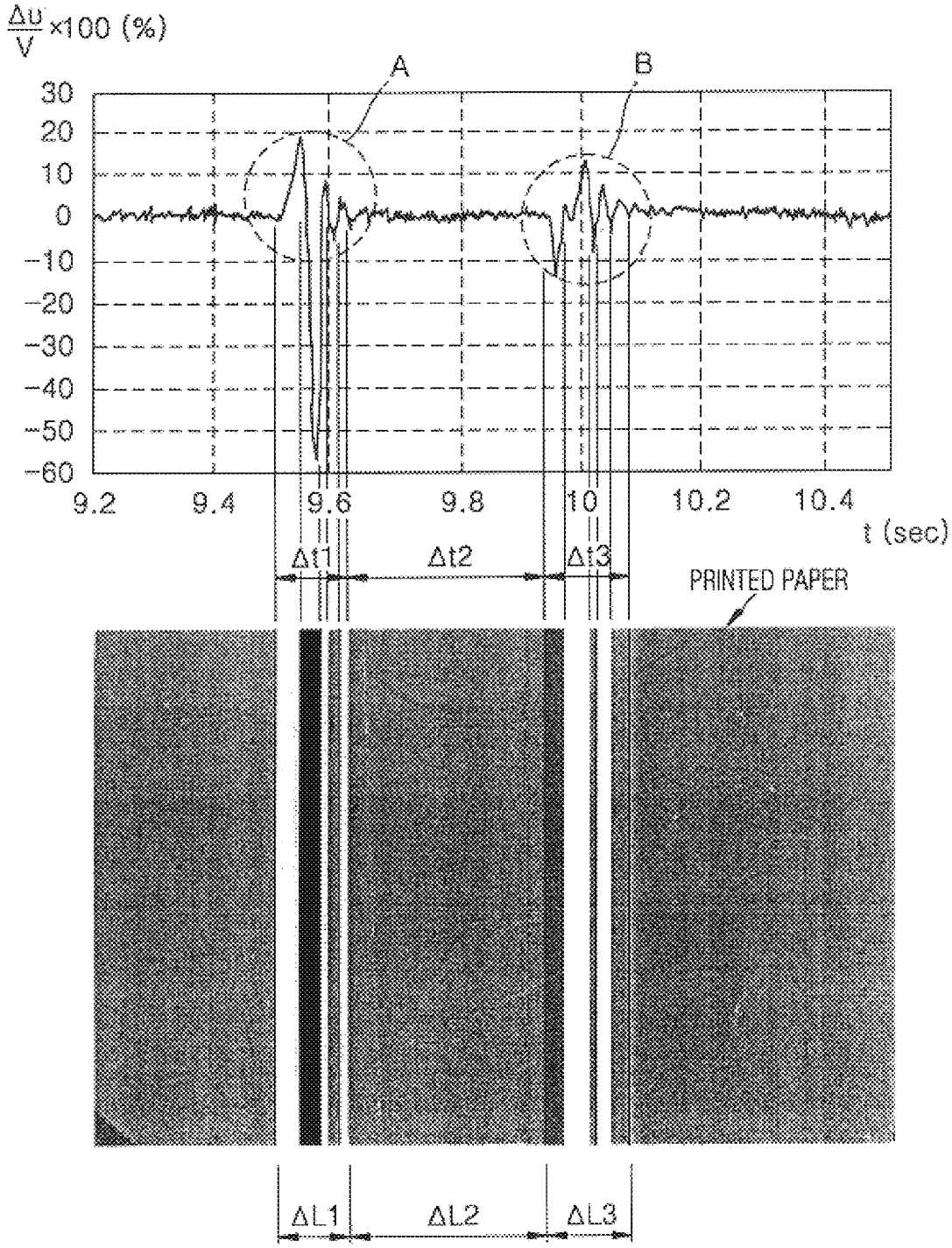
FIG. 2 (PRIOR ART)
FIG. 2 is a graph showing changes in the speed of the photoreceptor web at the moment when the leading edge of paper passes through a transfer nip or the trailing edge thereof is exhausted from the transfer nip in a conventional indirect transfer type image forming apparatus, and a banding phenomenon of an image according to the above change, obtained through experiments.

FIG. 1 is a view showing the structure of a general indirect transfer type image forming apparatus. Referring to the drawing, the image forming apparatus includes a photoreceptor medium 10 such as a photoreceptor web, circulating an endless path by being supported by a plurality of rollers 12, 14 and 16, a development unit 20 for developing with developer an electrostatic latent image area formed on the photoreceptor medium 10, a transfer unit 30 for transferring a toner image developed on the surface of the photoreceptor web to a sheet of paper P, and a paper supply unit 40 for supplying paper P toward the transfer unit 30. Reference numeral 32 denotes a laser scanning unit. The development unit 20, separated from the photoreceptor medium 10 at the initial stage, begins an image forming process as the development unit 20, a drying unit (not shown) and the transfer unit 30 are pressed to the photoreceptor medium 10 by a predetermined pressure.

The transfer unit 30 includes a transfer roller 22, rotating at a predetermined speed in close contact with the photoreceptor medium 10, for transferring a toner image formed on the photoreceptor medium 10 to the paper P to print the image, and a fusing roller 24, rotating in close contact with the transfer roller 22, for pressing the paper P toward the transfer roller 22 to fuse and fix the toner image on the paper P. Here, the fusing roller 24 and the transfer roller 22 are disposed to be capable of being separated a predetermined distance from the transfer roller 22 and the photoreceptor medium 10, respectively.

Figure 3A:
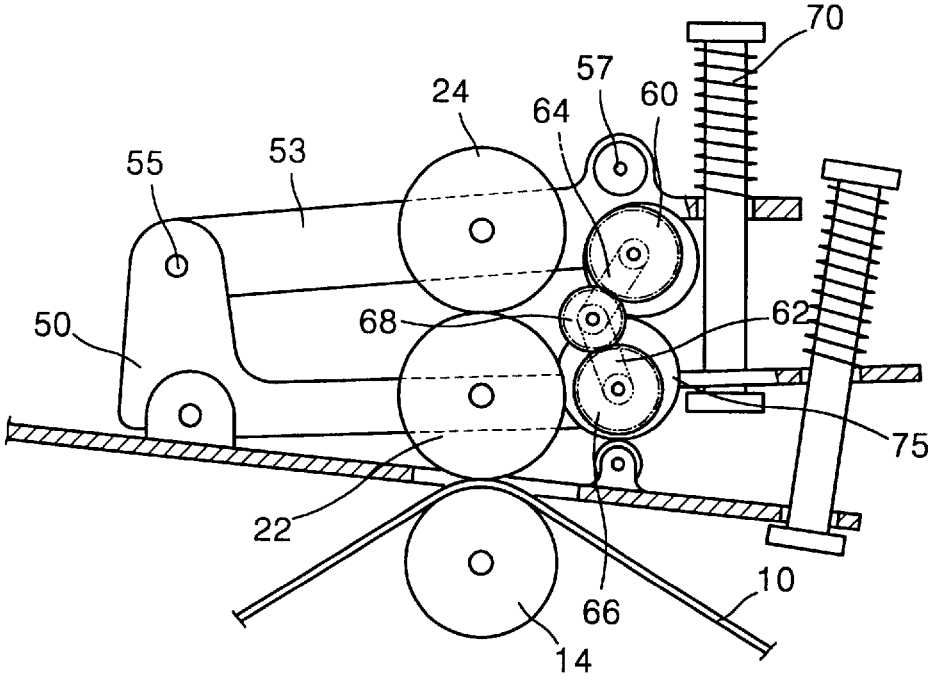
FIGS. 3A and 3B are views showing the structure for separating the transfer roller and the fusing roller of the indirect transfer type image forming apparatus.

The applicant has developed an image forming apparatus in which a separation between the transfer roller 22 and the fusing roller 24 is possible. The image forming apparatus, as shown in FIG. 3A, includes an assembling/disassembling means for selectively assembling and disassembling the photoreceptor web 10, the transfer roller 22 and the fusing roller 24. Here, only the assembling and disassembling operation between the fusing roller 24 and the transfer roller 22 will be described. The transfer roller 22 is supported by a first plate 50 and a second plate 53 supporting the fusing roller 24 is rotatably coupled to a rotation shaft 55 at one side of the first plate 50. Also, the first plate 50 and the second plate 53 are elastically biased by an elastic means 70 at the other side facing the rotation shaft 55 in a direction that they approach each other.

Figure 3B:
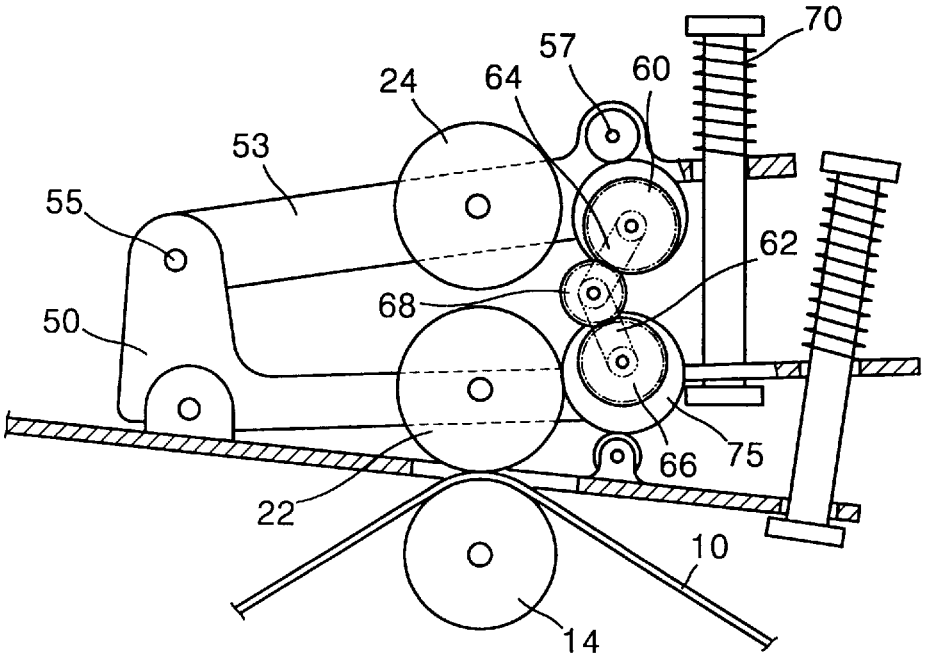

A second cam 60 closely contacting a cam protrusion 57 provided at the second plate 53 is rotatably installed at the first plate 50. The second cam 60 is dynamically connected to a first cam 75 via first and second intermediate gears 66 and 68 supported by first and second engagement levers 62 and 64. Thus, as the first cam 75 rotates, the second cam 60 rotates by the first and second intermediate gears 66 and 68. Also, as the second cam 60 rotates, the cam protrusion 57 of the second plate 53 is lifted. Accordingly, the second plate 53 rotates counterclockwise with respect to the drawing sheet around the rotation shaft 55. Thus, the fusing roller 24 supported by the second plate 53 is separated from the transfer roller 22, as shown in FIG. 3B. Contrarily, when the first cam 75 is rotated in the opposite direction, the force applied to the first cam 75 is released and the second plate 53 returns to the original position by a restoration force of the elastic means 70.

In the indirect transfer type image forming apparatus having the above separating structure, a paper supply path 42 is provided to the paper supply unit 40 and a pair of registration rollers 44 are installed on the paper supply path 42. A registration nip $N_r$ is formed at a portion where the registration rollers 44 are engaged with each other. The registration rollers 44 are for aligning the paper P before the paper P is supplied to the transfer nip $N_r$ formed between the transfer roller 22 and the fusing roller 24. Also, to detect whether the paper P supplied along the paper supply path 42 arrives at the registration nip $N_r$ or is exhausted therefrom, the paper supply unit 40 provides a paper detection sensor 46. The paper detection sensor 46 detects whether the paper is jammed by checking the time the leading edge of the paper P arrives at the registration roller 44. Also, the paper detection sensor 46 matches the time when the toner image transferred to the transfer roller arrives at the transfer nip $N_t$, with the time when the paper arrives at the transfer nip $N_t$. Thus, when the distance between the transfer nip $N_t$ and the registration roller 44 is set and the rotation speed of the registration roller 44 are known, the timing of elevating the fusing roller 24 can be controlled in tune with the timing of arriving at the transfer nip $N_t$ of the leading end of the paper P.

Preferably, the paper detection sensor 46 is used for anticipating the time the paper P enters the transfer nip $N_t$ from the point when the leading edge $E_l$ of the paper P passes the registration roller 44, and the time the paper P is exhausted therefrom. That is, the paper detection sensor 46 accurately matches the timing of elevating of the fusing roller 24 with the time the leading edge $E_l$ and the trailing edge $E_t$ of the paper P passes through the transfer nip $N_t$.

Figure 4:
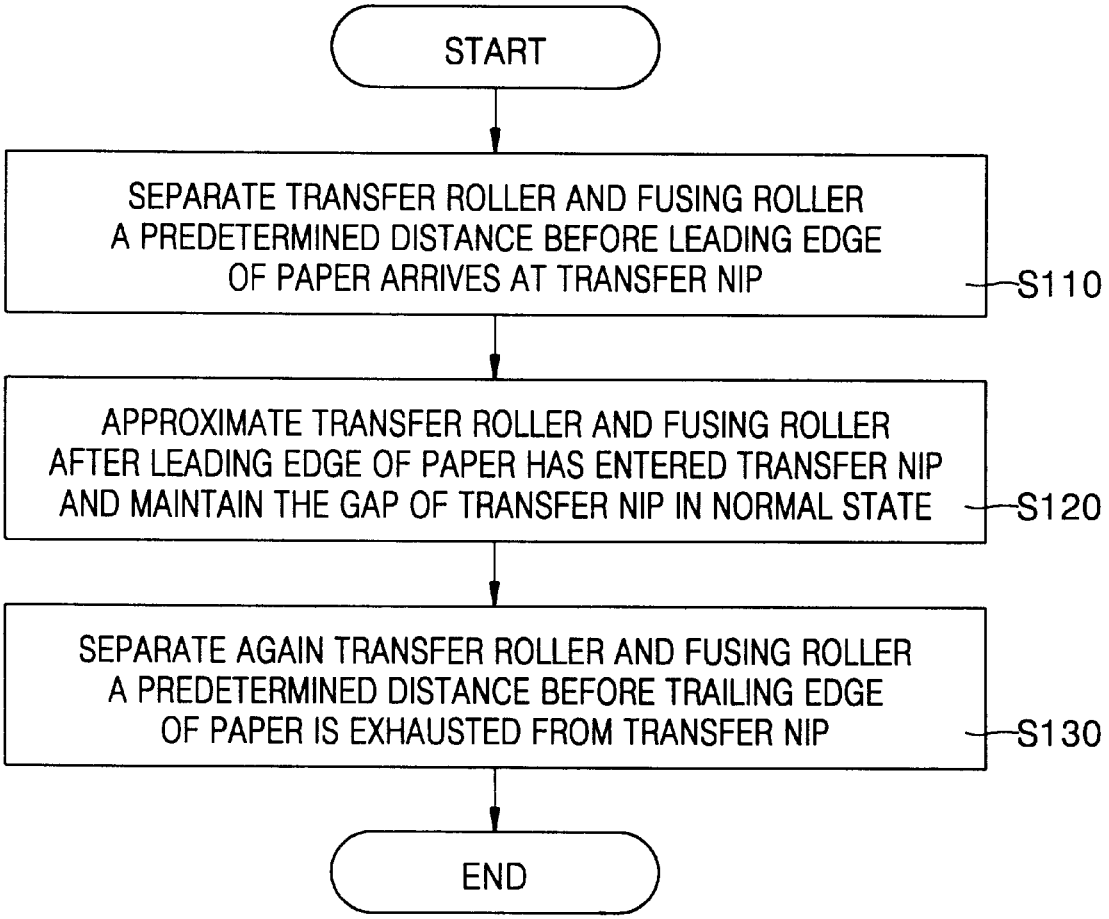
FIG. 4 is a flow chart for explaining a banding reduction method of a photoreceptor medium of an indirect transfer type image forming apparatus according to the preferred embodiment of the present invention.
Figure 5A:
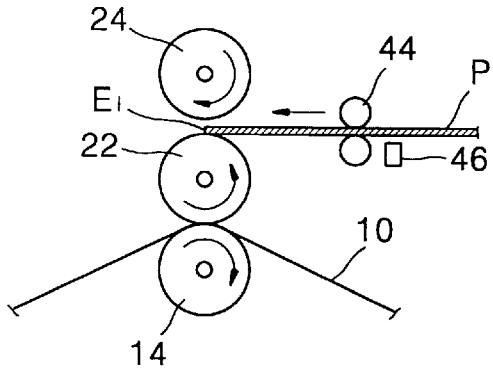
FIGS. 5A through 5C are views showing a transfer unit portion for explaining the banding reduction method shown in FIG. 4.
Figure 5B:
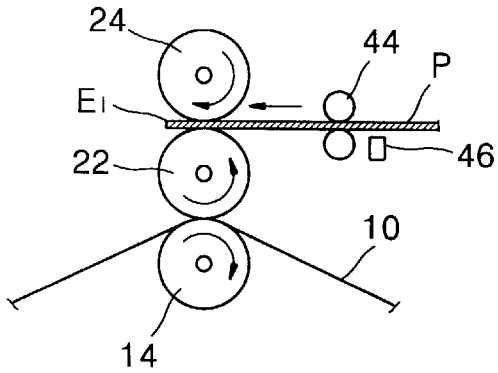
Figure 5C:
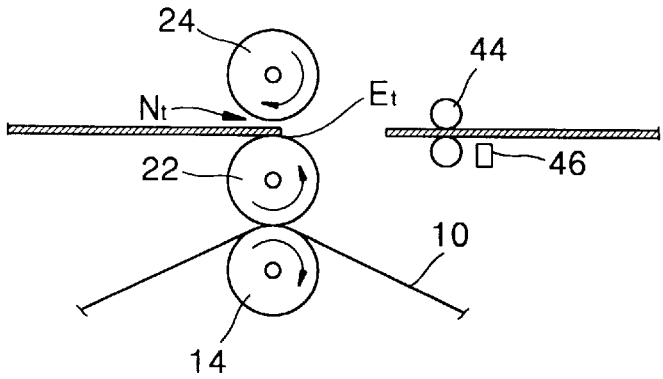

FIG. 4 is a flow chart for explaining a banding reduction method of a photoreceptor medium of an indirect transfer type image forming apparatus according to the preferred embodiment of the present invention; and FIGS. 5A through 5C are views showing a transfer unit portion for explaining the banding reduction method. The structural elements having the same reference numerals as those indicated in FIG. 1 are the members having the same functions.

Referring to FIGS. 4 through 5C, the banding reduction method of a photoreceptor medium of a printer having the above structure will be described.

First, in step S110 and referring to FIG. 5A, the fusing roller 24 is lifted to be separated from the transfer roller 22, before the leading edge $E_l$ of the paper P enters the transfer nip $N_t$ by the registration rollers 44 rotating at a constant speed. The registration rollers 44 are driven by a controller (not shown) according to the timing control. To remove a pressing force of the fusing roller 24 against the transfer roller 22 before the paper supplied enters the transfer nip $N_t$, the fusing roller 24 is slightly lifted by driving a cam driving motor (not shown).

The lift of the fusing roller 24 may minimize the change in circulating speed of the photoreceptor medium 10 due to the leading edge $E_l$ of the paper P. This is to minimize the impact generated when the paper P enters the transfer nip $N_t$.

Next, in step S120 and referring to FIG. 5B, after the leading edge $E_l$ of the paper P passes through the transfer nip $N_t$, the lifted fusing roller 24 is lowered and the transfer nip $N_t$ is returned to the normal state. That is, the fusing roller 24 is rotated in a direction in which the cam driving motor applies a pressing force and maintains a normal pressing state in which a normal image forming operation is performed. The image transferred to the transfer roller 22 is transferred again to the paper P and adheres to the paper P by the fusing roller 24.

Next, in step S130 and referring to FIG. 5C, the transfer roller 22 and the fusing roller 24 are separated from each other by lifting the fusing roller 24 a predetermined distance before the trailing edge $E_t$ of the paper P is exhausted from the transfer nip $N_t$. That is, by checking the size of the paper P and the driving time, the pressing force of the fusing roller 24 is released just before the trailing edge $E_t$ of the paper P passes through the transfer nip $N_t$. Preferably, the separation distance is the same as that of separation occurring when the leading edge $E_l$ passes through the transfer nip $N_t$.

Next, a banding reduction method of a photoreceptor medium of an indirect transfer type image forming apparatus according to another preferred embodiment of the present invention will now be described.

Since the transfer roller 22 and the fusing roller 24 both have elasticity, the two rollers 22 and 24 can be in contact with each other in a state in which the pressing force is reduced. Here, in the normal state, a pressing force between the transfer roller 22 and the fusing roller 24 is maintained at about 70 kgf. Thus, when the paper passes between the transfer roller 22 and the fusing roller 24 in the state in which the pressing force between the transfer roller 22 and the fusing roller 24 is reduced less than that in the normal state, without being completely removed, impact by the paper can be reduced.

Figure 6:
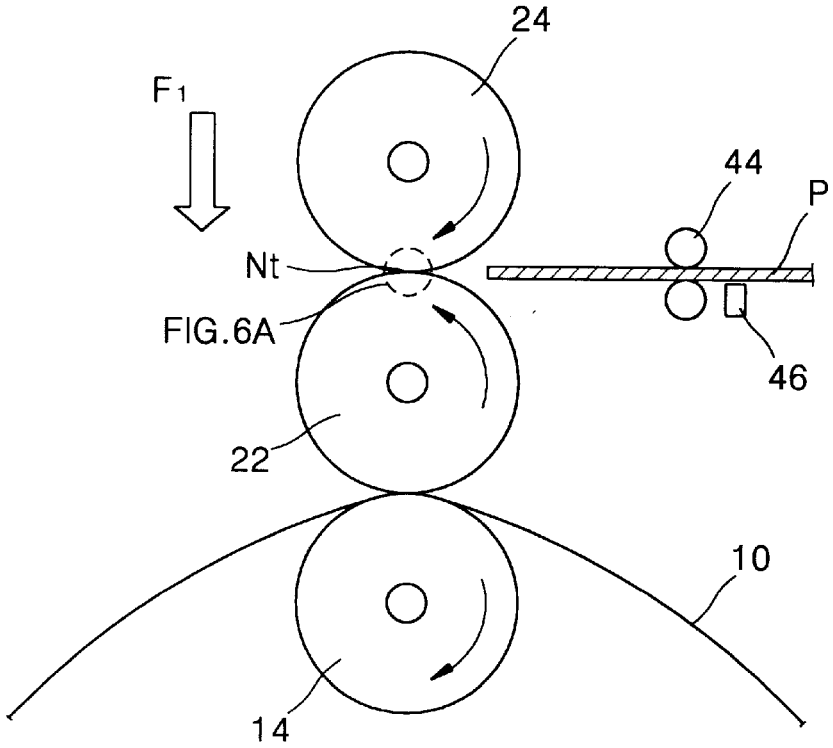
FIG. 6 is a view showing a state in which a pressing force between the transfer roller and the fusing roller is normally applied in an indirect transfer type image forming apparatus according to another preferred embodiment of the present invention.
Figure 6A:
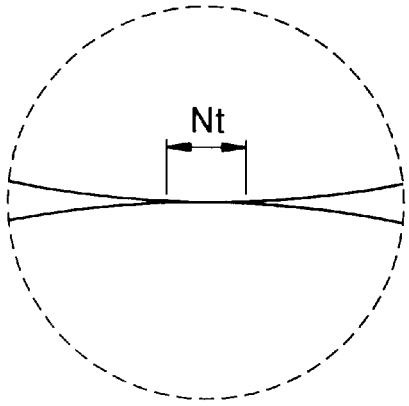
FIG. 6A is a partially enlarged view of FIG. 6.
Figure 7:
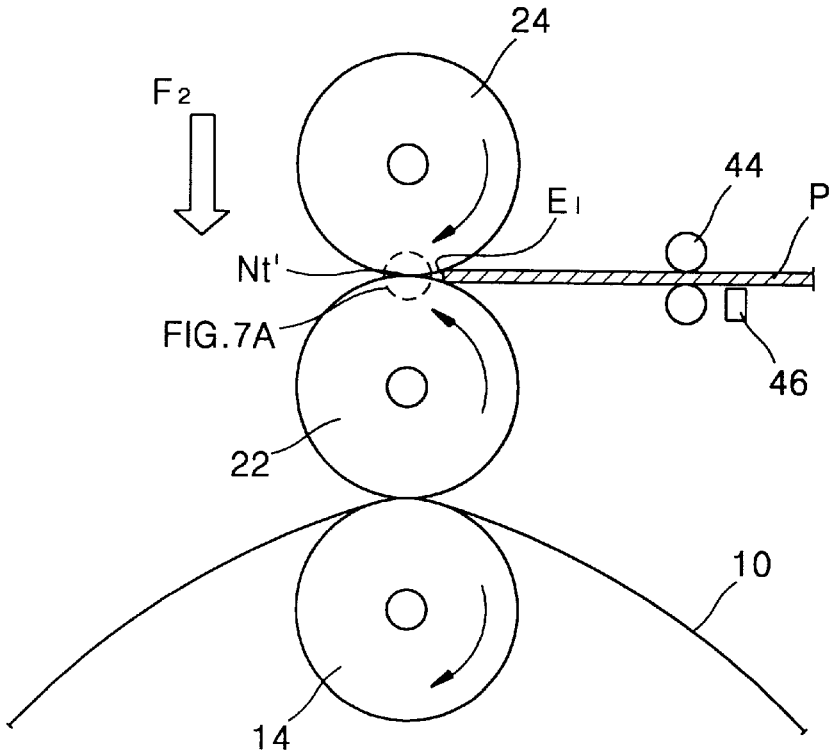
FIG. 7 is a view showing a state in which a pressing force between the transfer roller and the fusing roller is applied less than that in the normal state in an indirect transfer type image forming apparatus according to another preferred embodiment the present invention.
Figure 7A:
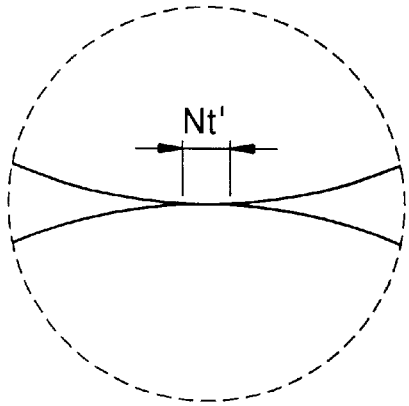
FIG. 7A is a partially enlarged view of FIG. 7.

That is, referring to FIGS. 6 and 6A, assuming that the pressing force applied between the transfer roller 22 and the fusing roller 24 in the normal state is $F_1$, and the transfer nip at this time is $N_t$, the paper P has not yet reached between the transfer roller 22 and the fusing roller 24. Referring to FIGS. 7 and 7A, assuming that the pressing force applied between the transfer roller 22 and the fusing roller 24 when the paper P passes between the transfer roller 22 and the fusing roller 24 is $F_2$, $F_2$ is less than $F_1$ of the normal state ($F_1>F_2$). Thus, by reducing the pressing force in the state in which the pressing force applied between the transfer roller 22 and the fusing roller 24 are in contact with each other, not completely separated, image banding can be reduced. Here, the transfer nip $N_t'$ in the reduced pressing force state is less than the transfer nip $N_t$ in the normal state ($N_t>N_t'$).

Also, the degree of reduction of the pressing force may vary according to the thickness of the paper P. In general, the thickness of paper used for typical image forming apparatuses is restricted to particular values. In the image forming apparatus according to the preferred embodiment of the present invention, the allowed thickness of paper is about 80 $\mu$m–230 $\mu$m and the degree that the pressing force is reduced can be allowed step by step according to the thickness of paper.

The banding reduction method of a photoreceptor medium of an indirect transfer type image forming apparatus according to the preferred embodiment of the present invention having the above structure will be described with reference to FIGS. 8A and 8B.

Figure 8A:
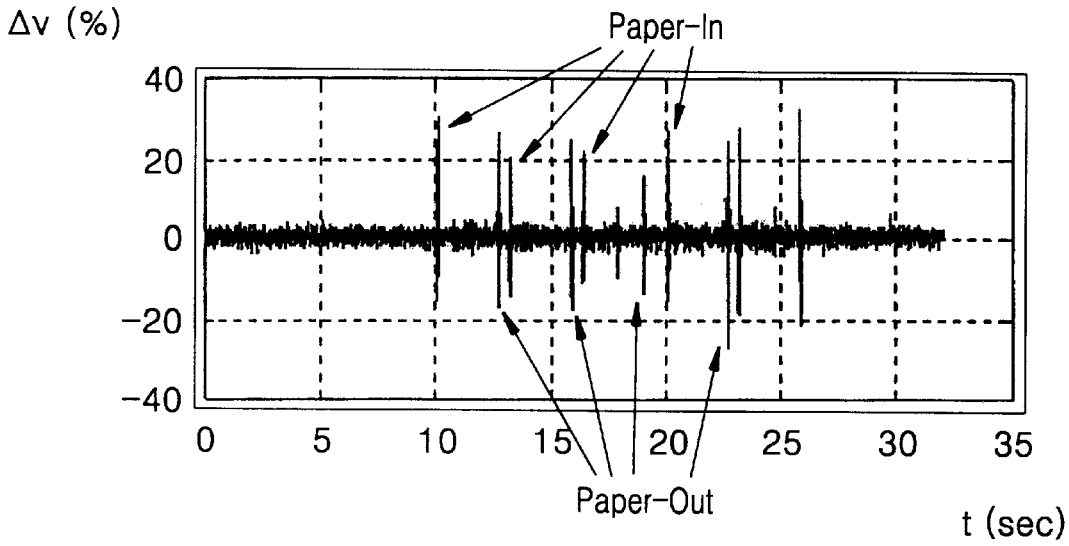
FIG. 8A(PRIOR ART)
FIG. 8A is a graph according to the conventional technology.

FIG. 8A is a graph showing the changes in the speed of the photoreceptor web with respect to time according to the conventional technology. That is, the banding of an image when a sheet of paper enters (paper-in) and is drawn (paper-out) is shown, and both changes of speed of the photoreceptor web occurring during the paper-in and paper-out are simultaneously shown. Such banding of an image is repeated when sheets of paper are continuously fed.

Figure 8B:
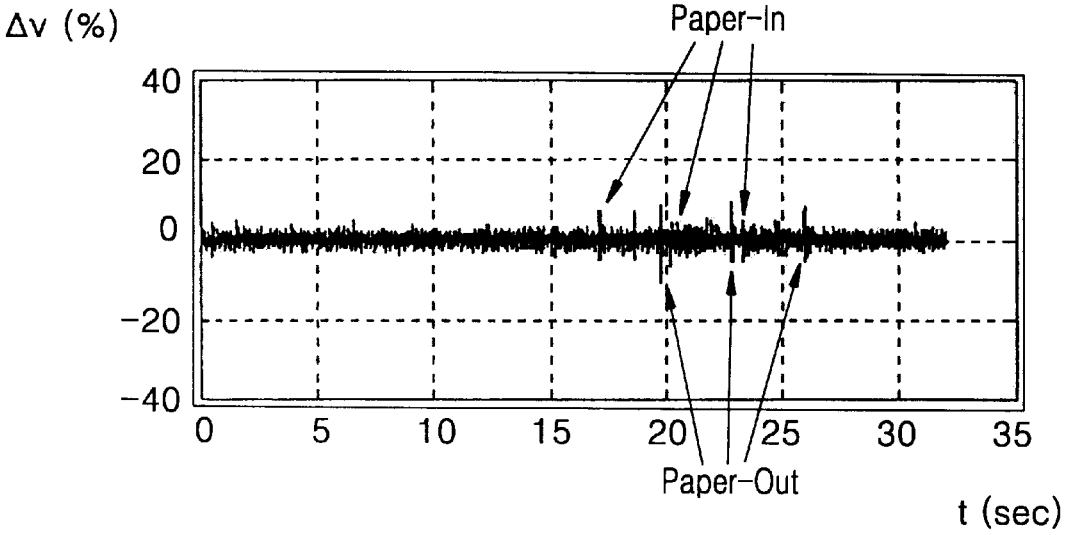
FIG. 8B is a graph for explaining the speed change reduction effect of the photoreceptor medium of the indirect transfer type image forming apparatus according to the preferred embodiment of the present invention.

FIG. 8B is a graph showing the changes in the speed of the photoreceptor web with respect to time according to a preferred embodiment of the present invention. It can be seen from the drawing that the speed change of a photoreceptor medium when the paper is inserted and exhausted is remarkably reduced compared to the conventional technology.

In addition to the transfer unit adopted to the present invention, there are various pressing means in the image forming apparatuses. These pressing means apply a pressing force at the same time image formation begins and release the pressing force when continuous printing ends so that there is no effect to the banding of an image according to the change of the pressing force. Thus, the banding of an image is generated only by the thickness of paper supplied at predetermined time intervals and passing through the transfer nip. Consequently, when the banding reduction method of the image forming apparatus according to the above method is used, an image of high resolution can be obtained.

The above banding reduction method can be applied to all image forming apparatuses of a type in which paper is exchanged during the transfer operation of the transfer roller adjacent to the photoreceptor medium while image formation continues.

As described above, the banding reduction method of a photoreceptor medium of an indirect transfer type image forming apparatus according to the present invention has the following merits.

First, as the pressing force of the transfer nip is adjusted when paper sheets enter or is exhausted from the transfer nip formed between the transfer roller and the fusing roller, the impact delivered to the transfer roller closely contacting the photoreceptor medium due to the thickness of the paper itself can be minimized. Therefore, changes in the speed of the photoreceptor medium in the sub-scanning direction are minimized so that the constancy of speed of the photoreceptor medium is maintained and image quality of high resolution can be represented.

Second, as a pressing driving cam of the transfer roller and fusing roller is used as it is when the control of elevation of the fusing roller is performed, it is convenient that existing structural elements can be used without addition of parts.

What is claimed is:

1. An image banding reduction method of a photoreceptor medium of an indirect transfer type image forming apparatus for preventing banding from occurring by a change in the speed of the photoreceptor medium generated when the leading edge and trailing edge of a sheet of paper pass through a transfer nip formed between a transfer roller and a fusing roller, the method comprising the steps of:

(A) separating the transfer roller and the fusing roller a predetermined distance from each other before the leading edge of paper enters the transfer nip;

(B) maintaining the transfer nip in a normal state after the leading edge of paper has entered the transfer nip; and (C) separating again the transfer roller and the fusing roller a predetermined distance from each other before the trailing edge of paper is exhausted from the transfer nip.

2. The method as claimed in claim 1, wherein a paper detecting sensor is disposed to be separated a predetermined distance from the transfer nip, and the time to separate the transfer roller and the fusing roller from each other is determined by the paper detecting sensor by detecting the moment when the leading edge of paper arrives at the transfer nip and the moment when the trailing edge of paper is exhausted from the transfer nip.

3. The method as claimed in claim 1, wherein the steps (A), (B), and (C) are applied to a case in which the thickness of the paper is 80 $\mu$m–230 $\mu$m.

4. The method as claimed in claim 2, wherein the steps (A), (B), and (C) are applied to a case in which the thickness of the paper is 80 $\mu$m–230 $\mu$m.

5. An image banding reduction method of a photoreceptor medium of an indirect transfer type image forming apparatus for preventing banding occurring by a change in the speed of the photoreceptor medium generated when the leading edge and trailing edge of a sheet of paper pass through a transfer nip formed between a transfer roller and a fusing roller, the method comprising the steps of:

(A) reducing a pressing force applied between the transfer roller and the fusing roller less than the pressing force in a normal state, before the leading edge of paper enters the transfer nip;

(B) restoring the pressing force applied between the transfer roller and the fusing roller to the normal state after the leading edge of paper has entered the transfer nip; and (C) reducing the pressing force applied between the transfer roller and the fusing roller to be less than the pressing force in the normal state, before the trailing edge of paper is exhausted from the transfer nip.

6. The method as claimed in claim 5, wherein a paper detecting sensor is disposed to be separated a predetermined distance from the transfer nip, and the time to reduce the pressing force applied between the transfer roller and the fusing roller is determined by the paper detecting sensor by detecting the moment when the leading edge of paper arrives at the transfer nip and the moment when the trailing edge of paper is exhausted from the transfer nip.

7. The method as claimed in claim 6, wherein the steps (A), (B), and (C) are applied to a case in which the thickness of the paper is 80 $\mu$m–230 $\mu$m.

8. The method as claimed in claim 7, wherein the pressing force applied between the transfer roller and the fusing roller is selectively adjusted according to the thickness of the paper.

9. The method as claimed in claim 5, wherein the steps (A), (B), and (C) are applied to a case in which the thickness of the paper is 80 $\mu$m–230 $\mu$m.

10. The method as claimed in claim 9, wherein the pressing force applied between the transfer roller and the fusing roller is selectively adjusted according to the thickness of the paper.

* * * * *